US005276003A

United States Patent [19]

Koshizuka

[11] Patent Number: 5,276,003

[45] Date of Patent: Jan. 4, 1994

[54] IMAGE RECEIVING SHEET FOR HEAT TRANSFER RECORDING

[75] Inventor: Kunihiro Koshizuka, Hino, Japan

[73] Assignee: Konica Corporation, Japan

[21] Appl. No.: 756,499

[22] Filed: Sep. 9, 1991

[51] Int. Cl.[5] ..... B41M 5/035; B41M 5/38

[52] U.S. Cl. ..... 503/227; 428/195; 428/500; 428/514; 428/520; 428/522; 428/913; 428/914

[58] Field of Search ..... 8/471; 428/195, 500, 428/913, 914, 514, 520, 522

[56] References Cited

FOREIGN PATENT DOCUMENTS 315063 5/1989 European Pat. Off. ..... 428/195
2580232 10/1986 France ..... 428/195
1145595 3/1969 United Kingdom ..... 428/195
2166689 5/1986 United Kingdom ..... 428/195

OTHER PUBLICATIONS

Patent Abstracts of Japan, vol. 13, No. 425 (M-873) (3773); Sep. 21, 1989 JPA-1-160681; Jun. 23, 1989.

*Primary Examiner*—Bruce H. Hess
*Attorney, Agent, or Firm*—Jordan B. Bierman

[57] ABSTRACT

An image receiving sheet used for heat transfer recording is disclosed. The image receiving layer of the sheet contains a vinyl chloride-vinylether copolymer. It is suitable to form images of high densities at a low thermal energy, free from fusion with a heat-transfer-recording ink sheet at the time of heat transfer, and excellent in image preservability.

18 Claims, No Drawings

IMAGE RECEIVING SHEET FOR HEAT TRANSFER RECORDING

The present invention relates to an image receiving sheet for heat transfer recording. More particularly, this invention relates to an image receiving sheet for heat transfer recording which is used to record images by heat-transferring a thermal diffusible dye contained in a heat sensitive layer of an ink sheet for heat transfer recording.

In recent years, color recording techniques base on the ink jet method, electrophotography and heat transfer method are studied as methods to obtain color hard copies.

Among them, the heat transfer method has advantages of being easy in handling and maintenance, allowing use of a smaller equipment and being cost-saving.

This heat transfer method falls into two types: a method to melt-transfer a meltable ink layer to an image-receiving sheet by heating imagewise a transfer sheet having the meltable ink layer on a support with a laser or thermal head, and a thermal diffusion transfer method (sublimation transfer method) to transfer diffusively a thermal diffusible dye alone to an image-receiving sheet using a transfer sheet having on a support an ink layer containing a heat diffusible dye (for example, sublimation dye).

In the thermal diffusion transfer method, the gradation of images can be controlled by changing the transferring amount of a thermal diffusible dye according to the change in heat energy of a thermal head.

Therefore, the thermal diffusion transfer method has come to attract attention recently as a method which provides color images having a continuous shade change through overlaprecording of cyan, magenta and yellow.

A typical example of image receiving sheet for heat transfer recording used in the above heat transfer recording methods is a laminated sheet in which a polyester resin layer is formed on a support.

In this image receiving sheet for heat transfer recording, the polyester layer functions as an image receiving layer, and a thermal diffusible dye is transferred thereto.

The thermal diffusion transfer method, though attracting an increasing attention, has a problem in providing images with a high quality and high preservability imagewise and rapidly according to electrical signals. And material technologies to dissolve the problem are still on the way to development.

And the image receiving sheet for heat transfer recording which uses the above polyester image receiving layer requires a high temperature to provide necessary images, and moreover has a problem in image preservability.

This problem has been pointed out not only for polyesters but also for other conventional resins used in image receiving layers.

In other words, it is difficult to obtain images of high densities at a low energy; or even if high density images are obtained at a low energy, there are liable to cause image discoloration and color fading, dye bleeding or image blurring by being subjected to light and heat in storing.

On the contrary, conventional heat-transfer-recording image receiving sheets have a disadvantage of causing fusion between the image receiving layer and an ink layer of an ink sheet for heat transfer recording at the time of heat transfer.

The present inventors reported previously that vinyl chloride-type resins were preferred as a resin for the image receiving layer in solving the problem stated above (Japanese Pat. O.P.I. Pub. No. 24996/1985).

After that, use of vinyl chloride-type resins in the image receiving layer was further reported. For example, Japanese Pat. O.P.I. Pub. No. 283595/1986 describes that the combination of a vinyl chloride-vinyl acetate copolymer and a polyester is useful as a resin for the image receiving layer.

SUMMARY OF THE INVENTION

The object of the present invention is to provide a heat-transfer-recording image receiving sheet capable of forming images of high densities at a low thermal energy, free from fusion with a heat-transfer-recording ink sheet at the time of heat transfer, and excellent in image preservability.

The image receiving sheet of the present invention has an image receiving layer containing a vinyl chloride-vinylether copolymer on a substrate.

DETAILED DESCRIPTION OF THE INVENTION

The present invention is hereunder described in detail. [I]

Image receiving sheet for heat transfer recording

The image receiving sheet for heat transfer recording can be composed of a base material and an image receiving layer formed thereon. But, if necessary, the image receiving sheet for heat transfer recording may be composed of a self-supporting image receiving layer. Such an image receiving sheet, composed of a self-supporting image receiving layer, allows reduction in number of parts because it uses no base material.

Image receiving layer

The image receiving layer is composed of a binder for image receiving layer and various additives. When necessary, the image receiving layer may be composed of a binder alone. <1>Binders for image receiving layer In the invention, a vinyl chloride-vinyl ether copolymer is used at least as a binder for image receiving layer.

The vinyl chloride-vinyl ether copolymer mentioned here is that having repetitive units of Formulas (A) and (B) in the principal chain as a basic skeletal structure.

(A) (B)

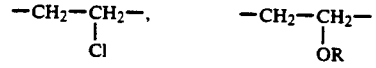

wherein R represents a straight-chain or branched alkyl group. Typical examples thereof are a methyl, ethyl, propyl, isopropyl, butyl, isobutyl and amyl group.

In the invention, there may be used any of those vinyl chloride-vinyl ether copolymers which have the above structure. Of them, vinyl chloride-isobutyl vinyl ether is particularly preferred.

The vinyl chloride-vinyl ether copolymers including the vinyl chloride-isobutyl vinyl ether can all be manufactured by known methods.

Typical commercially available products thereof are Laroflex MP-25, Laroflex MP-45 and Laroflex MP-60 (products of BASF).

Though a vinyl chloride-vinyl ether copolymer may be used singly in the invention, it is preferable to use jointly with other resins.

When a vinyl chloride-vinyl ether copolymer is combined with other resins, it is preferable that the amount of the compound be more than 10% by weight of the total resins.

The term other resins used here means a polyester resin, polyvinyl chloride resin, vinyl chloride copolymer (for example, vinyl chloride-vinyl acetate copolymer), polyacrylate, polyvinylpyrrolidone, polycarbonate, cellulose triacetate, styrene-acrylate resin, vinyltoluene-acrylate resin, polyurethane resin, polyamide resin, urea resin, polycaprolactone resin, styrene-maleic anhydride resin, and polyacrylonitrile resin. Among them, a polyester resin and vinyl chloride copolymer are particularly preferred.

These resins may be synthesized for captive use, or may be procured on the market.

Usable commercially available polyester resins include, for example, Vylon 200, Vylon 290, Vylon 600 (products of Toyobo.), KA-1038C (product of Arakawachemical) and TP220, TP235 (products of Nippon Synthetichemical).

Among the vinylchloride copolymer a preferable example is vinyl chloride-vinylacetate copolymer.

The above vinyl chloride-vinyl acetate copolymer resin has a vinyl chloride content of preferably 50 to 100 wt % and a polymerization degree of preferably 50 to 2,500.

The vinyl chloride-vinyl acetate copolymer resin is not necessarily composed only of a vinyl chloride component and a vinyl acetate component, it may contain a vinyl alcohol component or a maleic acid component within the limits not impairing the object of the invention.

Examples of such vinyl chloride-vinyl acetate copolymer resins are S-lec A, S-lec C, S-lec M (products of Sekisui Chemical), vinyl chloride copolymers VACH, vinyl chloride copolymers VYHH, vinyl chloride copolymers VMCH, vinyl chloride copolymers VYHD, vinyl chloride copolymers VYLF, vinyl chloride copolymers VYNS, vinyl chloride copolymers VMCC, vinyl chloride copolymers VMCA, vinyl chloride copolymers VACD, vinyl chloride copolymers VERR, vinyl chloride copolymers VROH (products of Union Carbide) and Denka Vinyl 1000GKT, Denka Vinyl 1000L, Denka Vinyl 1000CK, Denka Vinyl 1000A, Denka Vinyl 1000LK2, Denka Vinyl 1000AS, Denka Vinyl 1000MT2, Denka Vinyl 1000CSK, Denka Vinyl 1000CS, Denka Vinyl 1000GK, Denka Vinyl 1000GSK, Denka Vinyl 1000GS, Denka Vinyl 1000LT3, Denka Vinyl 1000D, Denka Vinyl 1000W (products of Denki Kagaku Kogyo).

From the viewpoint of physical properties, it is preferable that the Tg of other resins used in the image receiving layer be within a range from −20° to 150° C. and especially from 40° to 120° C.

The molecular weight of a binder for the image receiving layer is preferably 2,000 to 100,000.

If the foregoing resins have activated reaction sites, they may be cross-linked or cured by means of radioactive rays, heat, moisture, or catalysts through the utilization of such activated reaction sites, or by giving the resins activated reaction sites if they have no activated reaction sites.

In such a case, there may be used radioactive monomers such as epoxy compounds or acrylic compounds, or cross-linking agents such as isocyanates. <2>Additives The image receiving layer may use a releasing agent, antioxidant, UV absorbent, light stabilizer, filler (inorganic particles, organic resin particles) or pigment. A plasticizer may also be used as a sensitizing agent.

The releasing agent enhances the releasing property between a heat-transfer recording ink sheet and a heat-transfer-recording image receiving sheet.

As such releasing agents, there can be used a silicone oil (including one called silicone resin); solid wax such as polyethylene wax, amide wax, Teflon wax, or surfactant of fluorine-type or phosphate-type. Of them, a silicone oil is preferred.

The silicone oil falls into two groups, namely the simple addition type to be simply added and the curing type to be cured through reaction.

In the simple addition type, a modified silicone oil is preferably used for its better compatibility with a binder.

Useful modified silicone oils are a polyester-modified silicone resin (or silicone-modified polyester), acryl-modified silicone resin (or silicone-modified acrylic resin), urethane-modified silicone resin (or silicone-modified urethane resin), cellulose-modified silicone resin (or silicone-modified cellulose resin), alkyd-modified silicone resin (or silicone-modified alkyd resin) and epoxy-modified silicone resin (or silicone modified epoxy resin).

That is to say, there can be favorably used a polyester-modified silicone resin containing a polysiloxane resin in the principal chain and formed by copolymerizing a polyester blockwise; polyester-modified silicone resin having as a side chain a dimethylpolysiloxane moiety directly linked to the polyester principal chain; or modified silicone oil or resin formed by block copolymerization, alternative copolymerization, graft copolymerization or random copolymerization between a dimethylpolysiloxane and a polyester.

In the invention, use of a polyester-modified silicone resin is particularly preferred.

Typical examples of the polyester-modified silicone resin include, for example, a block copolymer between a polyester obtained by copolymerization of a diol and a dibasic acid or ring-opening copolymerization of caprolactone and a dimethylpolysiloxane (including a copolymer in which both ends or one end of the dimethylpolysiloxane is blocked with the polyester, and one in which the polyester is blocked with the polysiloxane), and copolymer in which a polyester being the principal chain is linked to dimethylpolysiloxanes being the side chains.

The addition amount of these simple addition-type silicone resins varies depending upon resin types and cannot be determined indiscriminately. But it is usually in a range from 0.5 to 50% and preferably from 1 to 20% by weight of a binder for image receiving layer.

As the curing type silicone oil, there are employed those of reaction-curing type, light-curing type and catalyst-curing type.

The reaction-curing type silicone oil includes one which cures through reaction between an amino-modified silicone oil and an epoxy-modified silicone oil.

Examples of the catalyst-curing type and light-curing type silicone oils include KS-705F-PS, KS-705F-PS-1, KS-770-PL-3 (catalyst-curing type silicone oils made by Shin-Etsu Chemical) and KS-720, KS-774-PL-3 (light-curing silicone oils made by Shin-Etsu Chemical).

The addition amount of these curing type silicone oils is preferably 0.5 to 30% by weight of a binder for image receiving layer.

The releasing layer may also be formed by coating the above releasing agent in the form of solution or dispersion in a suitable solvent on a portion of the image receiving layer's surface and then drying it.

Useful examples of the foregoing antioxidants are those described in Japanese Pat. O.P.I. Pub. Nos. 182785/1984, 130735/1985 and 127387/1989, in addition to conventional compounds used for improving image durability of photographs or other image recording materials.

Examples of the foregoing Uv absorbent and light-stabilizer are include those compounds which are described in Japanese Pat. O.P.I. Pub. Nos. 158287/1984, 74686/1988, 145089/1988, 196292/1984, 229594/1987, 122595/1988, 283595/1986 and 204788/1989, besides conventional compounds used for improving image durability of photographs or other image recording materials.

As the foregoing filler, inorganic fine particles or organic resin particles are used.

Examples of the inorganic fine particles are silica gel, calcium carbonate, titanium oxide, acid clay, activated clay and alumina; examples of the organic fine particles include resin particles such as fluororesin particles, guanamine resin particles, acrylic resin particles and silicone resin particles. The addition amount of these inorganic or organic resin particles varies depending upon their specific gravities, but is preferably 0.1 to 70 wt %.

Typical examples of the foregoing pigment are titanium white, calcium carbonate, zinc oxide, barium sulfate, silica, talc, clay, kaolin, activated clay and acid clay.

As the above plasticizer, there are used phthalates (for example, dimethyl phthalate, dibutyl phthalate, dioctyl phthalate, didecyl phthalate), adipates (for example, dioctyl adipate, methyl lauryl adipate, di-2-ethylhexyl adipate, ethyl lauryl adipate), oleates, succinates, maleates, sebacates, citrates, epoxy stearic acid, epoxides, and further, phosphates such as triphenyl phosphate, tricresyl phosphate, and glycol esters such as ethyl phthalyl ethyl glycolate, butyl phthalyl butyl glycolate.

In the invention, the addition amount of the whole additives is usually in a range from 0.1 to 50% by weight of a binder for image receiving layer.

Base materials

Base materials usable in the invention are, for example, paper, coated paper, synthetic paper (a composite material prepared by laminating a polypropylene or polystyrene film with paper), white polyethylene terephthalate base film, transparent polyethylene terephthalate base film, and polyolefine-coated paper.

The thickness of a base material is generally 20 to 300 μm, preferably 30 to 300 μm.

[II] Preparation of image receiving layer for heat transfer recording

Image receiving sheets for heat transfer recording can be manufactured by the coating method which comprises steps of preparing a coating solution for image receiving layer by dissolving or dispersing, in a solvent, components to form an image receiving layer, applying the coating solution for image receiving layer to the surface of a base material, and then drying it.

Further, image receiving sheets may also be manufactured by the laminating method, which comprises melt-extrusion of a mixture of components to form an image receiving layer on the base material's surface.

In the above coating method, there may be used conventional solvents such as water, alcohols, methyl ethyl ketone, toluene, dioxane and cyclohexanone.

When the above laminating method is employed, the coextrusion method may also be applicable.

The image receiving layer may be formed over the whole surface of a base material or on a portion of a base material.

The thickness of the image receiving layer formed on a base material is generally 2 to 50 μm and preferably about 3 to 20 μm.

In case an image receiving layer is self-supporting and constitutes said image receiving layer by itself, the thickness of the image receiving layer is 60 to 200 μm, preferably about 90 to 150 μm.

In the heat-transfer-recording image receiving sheet of the invention, a releasing layer containing a releasing material (the above silicone resin, modified silicone resin, silicone film, or cured material thereof) may be laminated on the surface of the image receiving layer, in order to prevent the fusion with an ink layer of heat-transfer-recording ink sheet.

The thickness of this releasing layer is usually 0.03 to 2.0 μm.

In addition, the heat-transfer-recording image receiving sheet of the invention may have a cushion layer between the base material and the image receiving layer.

When the cushion layer is provided, it reduces noise and helps transfer recording of images corresponding to image information with a high reproducibility.

Materials which constitute a cushion layer are, for example, a urethane resin, acrylic resin, ethylene-type resin, butadiene rubber and epoxy resin.

The thickness of the cushion layer is usually 1 to 50 μm, preferably 3 to 30 μm.

[III] Ink sheet for heat transfer recording

The ink sheet for heat transfer recording is composed of a support and an ink layer formed thereon.

Ink layer

The ink layer contains a thermal diffusible dye and a binder as basic materials.

<1>Thermal diffusible dye

Usable thermal diffusible dyes are cyan dyes, magenta dyes and yellow dyes.

Examples of the cyan dye are those naphthoquinone-type dyes, anthraquinone-type dyes and azomethine-type dyes which are described in Japanese Pat. O.P.I. Pub. Nos. 78896/1984, 227948/1984, 24966/1985, 53563/1985, 130735/1985, 131292/1985, 239289/1985, 19396/1986, 22993/1986, 31292/1986, 31467/1986, 35994/1986, 49893/1986, 148269/1986, 191191/1987, 91288/1988, 91287/1988 and 290793/1988.

Examples of the magenta dye are those anthraquinone-type dyes, azo dyes and azomethine dyes which are described in Japanese Pat. O.P.I. Pub. Nos. 78896/1984, 30392/1985, 30394/1985, 253595/1985, 262190/1896, 5992/1988, 205288/1988, 159/1989 and 63194/1989.

Examples of the yellow dyes are those methine-type dyes, azo-type dyes, quinophthalone-type dyes and anthraisothiazoletype dyes which are described in Japanese Pat. O.P.I. Pub. Nos. 78896/1984, 27594/1985, 31560/1985, 53565/1985, 12394/1986 and 122594/1988.

Particularly preferred thermal diffusible dyes are azomethine dyes prepared by coupling a compound having an open-chained or close-chained active methylene group with an oxidation product of a p-phenylenediamine derivative or an oxidation product of a p-aminophenol derivative, and indoaniline dyes prepared by coupling a phenol or naphthol derivative with an oxidation product of a p-phenylenediamine derivative or an oxidation product of a p-aminophenol derivative.

When an image to be formed is of monochrome, the thermal diffusible dye contained in the ink layer may be any of a yellow dye, magenta dye and cyan dye.

According to the color tone of the image to be formed, there may be contained two or more of the above three types of dyes, or other thermal diffusible dyes.

The amount of the thermal diffusible dye to be used is usually 0.1 to 20 g and preferably 0.2 to 5 g per square meter of support.

<2>Binder

Usable binders are, for example, a cellulose-type resin such as ethyl cellulose, hydroxyethyl cellulose, ethylhydroxyethyl cellulose, hydroxypropyl cellulose, methyl cellulose, cellulose acetate or cellulose acetobutyrate; vinyl-type resin such as polyvinyl alcohols; polyvinyl formal, polyvinyl butyral, polyvinylpyrrolidone; polyester; polyvinyl acetate, polyacrylamide, polyvinylacetacetal, styrene resin, styrene copolymer resin, polyacrylate, polyacrylic acid; rubber-type resin; olefine-type resin; and polyester.

Among these resins, a polyvinyl butyral, polyvinyl acetacetal and cellulose-type resin are preferred for their high preservability.

These binders may be used singly or in combination of two or more types.

The weight ratio of the binder to the thermal diffusible dye is preferably 1:10 to 10:1 and especially 2:8 to 8:2.

<3>Other optional components

Further, the foregoing ink layer may contain various additives within the limits not impairing the object of the invention.

Such additives include a silicone resin; silicone oil (including curing type); silicone-modified resin, fluororesin; surfactant; releasing compound such as wax; filler such as silica gel, metal oxide, carbon black or resin fine particles; and curing agent capable of reacting with binder components (for example, radioactive-ray-activated compounds including isocyanates and acrylics).

In addition, meltable compounds such as waxes and higher fatty esters described in Japanese Pat. O.P.I. Pub. No. 106997/1984 may also be used as an additive to facilitates image transfer.

Support

As a support in the invention, there may be used any of those which have a high dimensional stability and stand the heat applied by a thermal head while recording. But preferable examples thereof are tissue papers such as condenser paper, glassine paper; and films of heat resistant plastics such as polyethylene terephthalate, polyethylene naphthalate, polyamide, polycarbonate, polysulfone, polyvinylalcohol, cellophane and polystyrene.

The thickness of a support is preferably 2 to 10 μm, and there may be provided a subbing layer on a support in order to enhance the adhesion between the support and a binder and prevent a dye from transferring or migrating to the support side.

Moreover, an antisticking layer may be formed on the reverse side of a support (in reverse of an ink layer) for preventing the support from fusing with a thermal head, sticking or creasing.

Such an antisticking layer usually has a thickness of 0.1 to 1 μm.

The shape of the support is not particularly limited. There may be employed, for example, sheets or films with large widths and strips or cards with small widths.

[IV] Manufacture of ink sheet for heat transfer recording

The ink sheet for heat transfer recording can be manufactured by steps of dispersing or dissolving the above-mentioned ink layer components in a solvent to prepare an ink-layer-forming coating solution, coating the solution obtained on the surface of a support, and drying the coated layer.

The foregoing binder is dissolved or dispersed into a latex, singly or in combination of two or more, in a solvent before use.

As such a solvent, there can be used water, alcohols (for example, ethanol, propanol), cellosolve (for example, methylcellosolve, ethylcellosolve), aromatics (for example, toluene, xylene, chlorobenzene), ketones (for example, acetone, methyl ethyl ketone), esters (for example, ethyl acetate, butyl acetate), ethers (for example, tetrahydrofuran, dioxane) and chlorinated solvents (for example, chloroform, trichloroethylene).

The above coating solution may be applied by conventional coating methods such as the sequential coating with a gravure roll, extrusion coating, wire bar coating and roll coating.

The ink layer may be formed over the whole surface of a support or on a portion of a support, as a layer containing a monochromatic thermal diffusible dye, or in a layer configuration in which a yellow ink layer containing a binder and a yellow dye, a magenta ink layer containing a binder and a magenta dye, and a cyan ink layer containing a binder and a cyan dye are provided in a specific order.

Further, a black ink layer containing a black image forming substance may be provided between the above three ink layers. This black ink layer may be a diffusion transfer type or a melt transfer type, either of which is useful to provide sharp images.

The thickness of the ink layer prepared as above is generally, 0.2 to 10 μm and preferably 0.3 to 3 μm.

For the sake of convenience when used, the heat-transfer-recording ink sheet of the invention may be perforated or provided with a detector mark to detect a position from which a color changes to a different one in one embodiment of the present invention.

Further, the layer configuration of the ink sheet for heat transfer recording is not limited to a structure having a support and a heat sensitive layer provided thereon; another layer may be formed on the ink layer.

For example, an overcoat layer may be provided in order to prevent the fusion between the ink layer and an image receiving sheet for heat transfer recording and the set-off of a thermal diffusible dye (blocking). [V] Image formation (heat transfer recording) In forming an image, the ink layer of a heat-transfer-recording ink sheet is superposed on the image receiving sheet, and then heat energy is applied imagewise to the interface between the ink layer and image receiving layer. Thereby, the thermal diffusible dye sublimates by an amount corresponding to the heat energy supplied, then moves to the image receiving layer side and is received thereby. As a result, an image is formed on the image receiving layer.

In the invention, the image receiving layer of a heat-transfer-recording image receiving sheet contains an epoxy-group-carrying vinyl chloride-type resin; accordingly, no high energy is required to obtain a necessary image density.

In other words, even a lower energy can provide a high density image.

The heat-transfer-recording image receiving sheet of the invention is immune from problems caused by light and heat during storing, such as the image's color-fading, discoloration, blur, and the dye's bleeding out. Moreover, it is prevented from fusing with a heat-transfer-recording ink sheet in the course of heat transfer recording.

In general, a thermal head is used as a heat source to apply heat energy. But other conventional means such as laser beams, infrared flashes and thermal pens can also be employed.

When a thermal head is used as a heat source, the heat energy given to the thermal head can be changed continuously or by stages, by modulating the voltage or pulse width to be applied to the thermal head.

When laser beams are used as a heat source to impart heat energy, the heat energy to be given can be changed by altering the quantity of light or irradiation area.

In this case, a laser beam absorbing material (in case of semiconductor laser, for example, carbon black or an infrared ray absorbing substance) may be contained in the ink layer or its vicinity in order to facilitates the absorption of laser beams.

Use of a dot generator having a built-in acoustic optical element allows to impart heat energy correspondingly to the size of dots.

When laser beams are used, it is preferable that a heat-transfer-recording ink sheet and a heat-transfer-recording image receiving sheet be contacted closely with each other.

When an infrared flash lamp is used as a heat source, it is preferable that heating be made via a colored layer (such as black) similarly to the case using laser beams.

Heating may also be made via a pattern of an image shaded continuously or a pattern of dots, or may be carried out in combination of a colored layer like an overall black layer and a negative pattern corresponding to a negative of the above pattern.

The heat energy may be applied from the ink sheet side or the image receiving layer side, or from both sides. For an effective heat energy utilization, however, heating from the ink sheet side is preferred.

Through the heat transfer recording as described above, a monochromatic image is formed on the image receiving layer of a heat-transfer-recording image receiving sheet. Further, a color image like a color photograph can be obtained by hybridizing necessary colors in the following manners.

In one method, heat-transfer-recording ink sheets of yellow, magenta, cyan, and black when necessary, are subjected in sequence to heat transfer processes corresponding to respective colors; as a result, a color-photograph-like color image of hybridized color is obtained.

In another method, there is employed a heat-transfer-recording ink sheet which has colored zones formed beforehand by being coated in respective colors, instead of the above heat-transfer-recording ink sheets of respective colors.

In this method, a yellow image is first heat-transferred with the yellow zone, a magenta image is then heat-transferred with the magenta area, and the same procedure is repeated for cyan. If necessary, this procedure is further repeated for black.

This method is also capable of providing a color-photograph-like color image, and moreover it has an advantage that exchange of heat-transfer-recording ink sheets is not required.

EXAMPLES

The present invention is hereunder described in more detail with the examples and comparative examples. In the description below, "part" means "part by weight".

EXAMPLE 1

A coating solution of the following composition to form a heat sensitive layer was coated on a corona-treated 6 μm thick polyethylene terephthalate film (product of Toray), by the wire bar coating method so as to give a dry thickness of 1 μm. After drying, a back-side treatment was made by letting fall a few drops of silicone oil (X-41-4003A made by Shin-Etsu Chemical) with a syringe on the back side which was not corona-treated, and allowing the drops to spread all over the surface, so that an ink sheet for heat transfer recording was obtained.

| Coating composition to form the heat-sensitive layer | |
|---|---|
| Disperse dye (Kayaset Blue 136 made by Nippon Kayaku) | 4 parts |
| Polyvinyl butyral (BX-1 made by Sekisui Chemical, polymerization degree: 1700) | 5 parts |
| Methyl ethyl ketone | 90 parts |
| cyclohexanone | 5 parts |

Next, a coating solution of the following composition to form an image receiving layer was coated on a 150-μm thick synthetic paper base (Yupo FPG-150 made by Oji Yuka Synthetic Paper) by the wire bar coating method. After predrying the coated base on a dryer, it was dried for 1 hour at 100 in an oven. Thus, there was obtained a heat-transfer-recording image receiving sheet having a 5-μm thick image receiving layer formed on the synthetic paper.

| Coating solution to form the image-receiving layer | |
|---|---|
| Vinyl chloride-isobutylvinylether copolymer (Laroflex-MP25 made by BASF) | 9 parts |
| Polyester-modified silicone oil (X-24-8310 made by Shin-Etsu Chemical) | 1 part |
| Methyl ethyl ketone | 40 parts |

Subsequently, the above ink sheet for heat transfer recording was superposed on the above image receiving sheet for heat transfer recording, so as to have the ink layer's surface of the former contact with the image receiving layer's surface of the latter. Then, image recording was conducted by heating the ink sheet from its support side under conditions of output: 0.4 W/dot, pulse width: 0.3 to 10 msec, and dot density: 6 dots/mm.

After the image recording, each sample was evaluated for the fusion between the ink sheet and image receiving sheet, transferred density on the image receiving layer of the image receiving sheet, heat resistance and light fastness of the image formed, employing the following criteria. The results are shown in Tale 1.

Fusion

O the heat-transfer-recording image receiving sheet is smoothly peeled off from the heat-transfer-recording ink sheet.

X the image receiving layer of the heat-transfer-recording image receiving sheet fuses with the heat-transfer-recording ink sheet and cannot be peeled off.

Transferred density (image preservability against heat)

The reflection density OD value was determined with an optical densitometer.

O OD value is 2.0 or more. Δ OD value ranges from 1.7 to 2.0.

X OD value is 1.7 or less.

Heat resistance

Each image receiving sheet keeping the image record was preserved for 72 hours in an environment of 77 and 80% RH and then checked for bleeding out of dyes.

O the dye image is not wore off easily when rubbed with the finger.

X the dye image is easily wore off when rubbed with the finger.

Light fastness (image preservability against light)

Each image receiving sheet was kept in a weather meter for 72 hours and then visually checked for discoloration in the image.

O little image discoloration

X noticeable image discoloration

EXAMPLE 2

The same procedure as in Example 1 was repeated, except that a coating solution of the following composition was used to form an image receiving layer. The results are shown in Table 1.

| Coating solution to form the image receiving layer | |
|---|---|
| Vinyl chloride-isobutylether copolymer (Laroflex-MP25 made by BASF) | 4 parts |
| Polyvinylchloride resin (TK-300, made by Shin-Etsu Chemical Co, polymerization degree: 300) | 5 parts |
| Polyester-modified silicone oil (DiaromarSP-712 made by Dainichiseika Co.,) | 1 part |
| Methyl ethyl ketone | 40 parts |

EXAMPLE 3

The same procedure as in Example 1 was repeated, except that a coating solution of the following composition was used to form an image receiving layer. The results are shown in Table 1.

| Coating solution to form the image receiving layer | |
|---|---|
| Vinyl chloride-isobutylvinylether copolymer (Laroflex-MP60 made by BASF) | 4 parts |
| Polyvinyl chloride (TK-300 made by Shin-Etsu Chemical, polymerization degree: 600) | 5 parts |
| Polyester-modified silicone oil | 0.5 parts |

-continued

| Coating solution to form the image receiving layer | |
|---|---|
| (X-24-8300 made by Shin-Etsu Chemical) | |
| Triphenylphosphate (plasticizer) | 0.5 parts |
| Methyl ethyl ketone | 40 parts |

COMPARATIVE EXAMPLE 1

The same procedure as in Example 1 was repeated, except that one of the component of coating solution vynilchloride-isobutylether copolymer was replaced with a polyvynilchloride resin (TK-300, made by Shin-Etsu Chemical) to from an image receiving layer.

The results are shown in Table 1.

COMPARATIVE EXAMPLE 2

The same procedure as in Example 1 was repeated, except that a coating solution of the following composition was used to form an image receiving layer.

The results are shown in Table 1.

| Coating solution to form the image receiving layer | |
|---|---|
| Polyester resin (Vylon 200 made by Toyobo, Co.) | 9.5 parts |
| Amino-modified silicone (KF-93 made by Shin-Etsu Chemical) | 0.25 part |
| Epoxy-modified silicone (X-22-343 made by Shin-Etsu Chemical) | 0.25 part |
| Methyl ethyl ketone | 40 parts |

TABLE 1

| | Fusion | Density | Heat resistance | Light fastness |
|---|---|---|---|---|
| Example 1 | O | O | O | O |
| Example 2 | O | O | O | O |
| Example 3 | O | O | O | O |
| Comp. example 1 | O | X | X | O |
| Comp. example 2 | O | Δ | O | X |

What is claimed is:

1. An image receiving sheet for a thermal diffusion transfer recording process, an ink sheet for use in combination with the image receiving sheet, the ink sheet having a support and an ink layer containing a heat diffusible dye and a binder, the image receiving sheet having an image receiving layer containing a vinylchloride-vinylether copolymer.

2. An image receiving sheet according to claim 1, wherein said vinyl chloride-vinylether copolymer is vinyl chlorideisobutylvinylether copolymer.

3. An image receiving sheet according to claim 1, wherein the image receiving layer is provided on a base material.

4. An image receiving sheet according to claim 3, wherein the image receiving layer has a thickness of 2 to 50 μm.

5. An image receiving sheet according to claim 2, wherein the vinyl chloride-vinylether copolymer is that having repetitive units of Formulas (A) and (B) in the principal chain:

(A) (B)

$$-CH_2-\underset{\underset{Cl}{|}}{CH_2}-, \qquad -CH_2-\underset{\underset{OR}{|}}{CH_2}-$$

wherein R is a straight-chain or branched alkyl group.

6. An image receiving sheet according to claim 5, wherein R is a methyl, ethyl, propyl, isopropyl, butyl, isobutyl or amyl group.

7. An image receiving sheet for heat transfer recording wherein the sheet has an image receiving layer containing a vinyl chloride-vinylether copolymer, and the image receiving layer is provided on a base material, and the base material is a synthetic paper.

8. An image receiving sheet for heat transfer recording wherein the sheet has an image receiving layer containing a vinyl chloride-vinylether copolymer, and the image receiving layer comprises polyester resin or vinylchloride-vinylacetate copolymer resin.

9. An image receiving sheet for heat transfer recording wherein the sheet has an image receiving layer containing a vinyl chloride-vinylether copolymer, and the image receiving layer comprises a modified silicone oil.

10. A process for obtaining thermal diffusion transfer images using an ink sheet and an image receiving sheet, the ink sheet having a support and an ink layer containing a heat diffusible dye and a binder, the image receiving sheet having an image receiving layer containing a vinyl chloride-vinylether copolymer, the process comprising:

positioning the ink layer in contact with the image receiving sheet, applying heat to the ink layer, thereby transferring the thermally diffusible dye to the image receiving layer.

11. A process for obtaining thermal diffusion transfer images according to claim 10 wherein said vinyl chloride-vinylether copolymer is vinyl chloride-isobutylvinylether copolymer.

12. A process for obtaining thermal diffusion transfer images according to claim 10 wherein the image receiving layer is provided on a base material.

13. A process for obtaining thermal diffusion transfer images according to claim 12 wherein the base material is a synthetic paper.

14. A process for obtaining thermal diffusion transfer images according to claim 12 wherein the image receiving layer has a thickness of 2 to 50 $\mu$m.

15. A process for obtaining thermal diffusion transfer images according to claim 10 wherein the image receiving layer comprises polyester resin or vinylchloridevinylacetate copolymer resin.

16. A process for obtaining thermal diffusion transfer images according to claim 10 wherein the image receiving layer comprises a modified silicone oil.

17. A process for obtaining thermal diffusion transfer images according to claim 10 wherein the vinyl chloride-vinylether copolymer is that having repetitive units of Formulas (A) and (B) in a principal chain:

(A) (B)

$$-CH_2-\underset{\underset{Cl}{|}}{CH_2}-, \qquad -CH_2-\underset{\underset{OR}{|}}{CH_2}-$$

wherein R is a straight or branched chain alkyl group.

18. A process for obtaining thermal diffusion transfer images according to claim 17 wherein R is a methyl, ethyl, propyl, isopropyl, butyl, isobutyl or amyl group.

* * * * *

UNITED STATES PATENT AND TRADEMARK OFFICE

CERTIFICATE OF CORRECTION

PATENT NO. : 5,276,003

DATED : January 4, 1994

INVENTOR(S) : K. KOSHIZUKA et al

It is certified that error appears in the above-identified patent and that said Letters Patent is hereby corrected as shown below:

On the Title Page, insert:

-- [30] Foreign Application Priority Data

September 12, 1990 [JP] Japan 243264/1990--

Signed and Sealed this

Tenth Day of May, 1994

*Attest:*

Bruce Lehman

BRUCE LEHMAN

*Attesting Officer*

*Commissioner of Patents and Trademarks*